United States Patent [19]

Moore

[11] 3,982,342

[45] Sept. 28, 1976

[54] INTERCHANGEABLE PRICE INDICATING SIGN

[75] Inventor: Charles T. Moore, Minneapolis, Minn.

[73] Assignee: Dayton-Hudson Corporation, Minneapolis, Minn.

[22] Filed: July 21, 1975

[21] Appl. No.: 597,361

[52] U.S. Cl. ..... 40/5

[51] Int. Cl.[2] ..... G09F 3/20

[58] Field of Search ..... 40/16, 17, 10, 5, 158, 40/122

[56] References Cited

UNITED STATES PATENTS

| | | | |
|---|---|---|---|
| 1,824,794 | 9/1931 | Rohlfes | 40/5 |
| 2,137,938 | 11/1938 | Black | 40/5 |
| 2,581,762 | 1/1952 | Hesse | 40/17 |
| 3,029,537 | 4/1962 | Hopp et al. | 40/17 |
| 3,452,463 | 7/1969 | Chaput | 40/17 |

*Primary Examiner*—Louis G. Mancene
*Assistant Examiner*—Wenceslao J. Contreras
*Attorney, Agent, or Firm*—Burd, Braddock & Bartz

[57] ABSTRACT

A price indicia holder for use in sign frames in stores for facilitating easy change of price information, and the resulting interchangeable sign. The indicia holder fits in the top of the sign frame suspended by means of an outwardly extending flange. The holder includes a pocket along its lower edge to receive the bottom edges of interchangeable price indicia elements. The indicia holder occupies half or less of the frame to permit display of related product information. The indicia holder may be used in single or double face signs.

10 Claims, 4 Drawing Figures

INTERCHANGEABLE PRICE INDICATING SIGN

This invention relates to interchangeable signs of the type in common use in stores comprised of a frame formed from channel stock and having a slot opening at the top for insertion and removal of cards bearing appropriate product and price information. More particularly, the invention relates to a price indicia holder for use in conjunction with such a sign frame for facilitating easy change of price information, and to the resulting interchangeable sign.

BACKGROUND OF THE INVENTION

Frame signs are in widespread use in department stores, variety stores, and similar merchandising establishments to display point-of-sale product and price information. The signs comprise a relatively flat rectangular frame open on at least one side, and generally on both sides, and having a relatively narrow retaining lip surrounding the relatively large opening in the frame. A pedestal base, or a counter mounting bracket, or the like, is provided to support the frame. The frame has a slot opening in the top extending the length of the frame for insertion and removal of cards which are slightly larger than the size of the frame opening and which bear appropriate information with respect to the goods being sold from that counter and the price of such goods.

PRIOR ART

Interchangeable frame signs as described have been available virtually unchanged for many years. The cards bearing product and price information are easily changed simply by sliding an old card upwardly through the top slot opening and replacing it with a new card. The appropriate information may be printed on both sides of a single card or separate cards may be inserted in the frame in back-to-back relation. However, when there is a change in price, as might occur during a special sales event of a few days duration, it is necessary that the entire card be replaced with another card bearing the new price information. Then, when the sale is over and the price reverts to its earlier level, the original card is reinstalled in the frame. This involves the printing of special cards for display of sale prices, and it requires careful handling and storage of the removed card for reuse when the sale event is over.

SUMMARY OF THE INVENTION

The present invention is directed to an interchangeable sign permitting change of price information for a sales event or other occasion for price fluctuation without the necessity of changing the related product information. The interchangeable sign is possible through the use of a price indicia holder which fits in the top of the conventional sign frame suspended by means of an outwardly extending flange and which includes a pocket along its lower edge to receive the bottom edges of a plurality of interchangeable price indicia elements. These price indicia elements can be easily interchanged to reflect the upward or downward fluctuation of the price.

DESCRIPTION OF THE DRAWINGS

The invention is illustrated in the accompanying drawings in which.

DESCRIPTION OF THE PREFERRED EMBODIMENT

Figure 1:
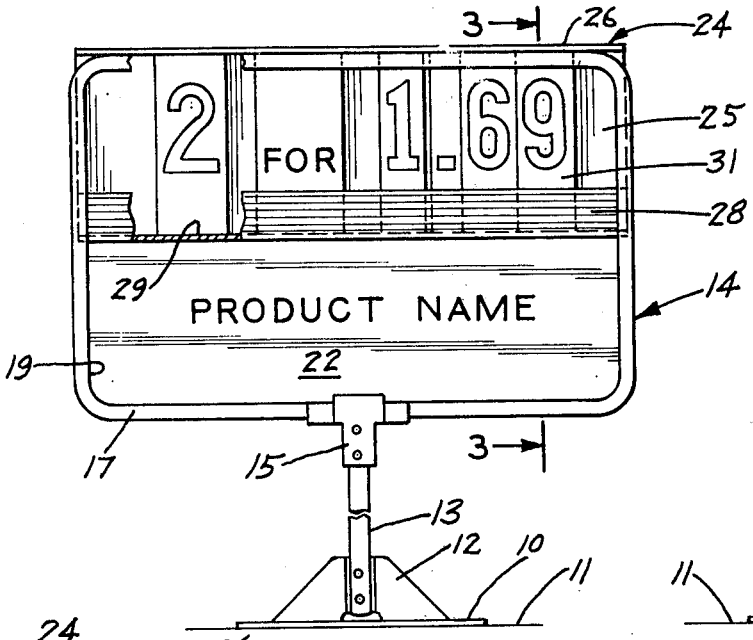
FIG. 1 is a front elevation of an interchangeable counter frame sign holder according to the present invention, partly broken away to show details of construction.
Figure 2:
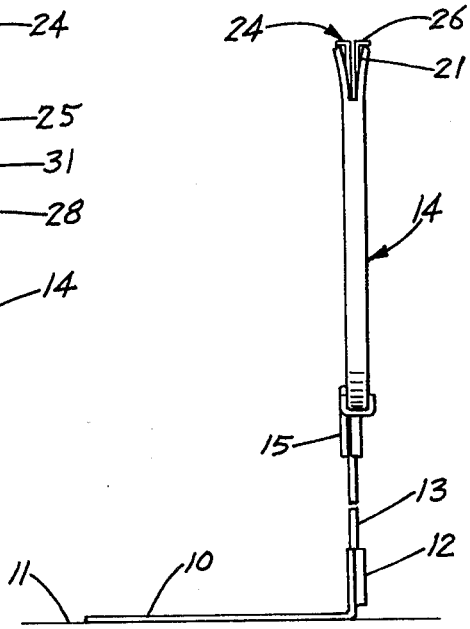
FIG. 2 is an end elevation thereof.
Figure 3:
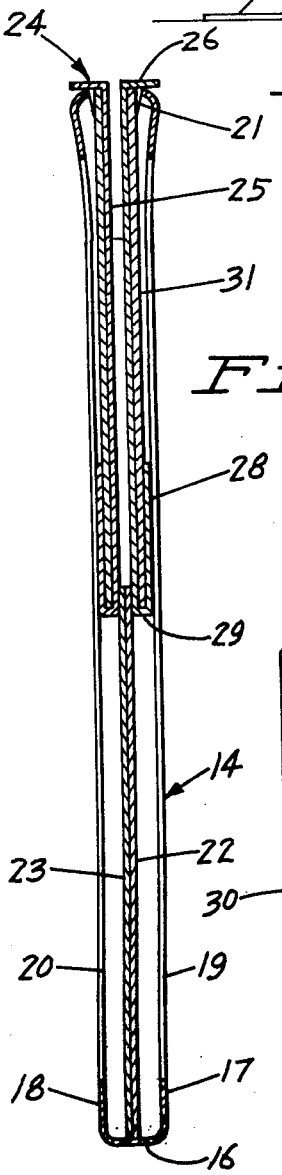
FIG. 3 is a vertical section on an enlarged scale on the line 3—3 of FIG. 1.

Referring now to the drawings, there is shown a counter frame sign holder comprising a flat horizontal base 10 adapted to rest upon a counter top 11. The base has a vertically extending portion 12 to which is secured the bottom end of a vertical post or standard 13. An open frame, indicated generally at 14, is secured to the upper end of post 13 by means of a T-fitting 15. The frame 14 is generally rectangular in configuration having a top, bottom and two ends. As best seen in FIG. 3, the frame is formed from a channel member having a central wall 16 between two parallel inwardly extending lips 17 and 18 whose inner edges define the openings 19 and 20 on the opposite sides of the frame. The lips serve as retaining members for the cards ordinarily inserted in the frame.

The channel member forming the top of the frame is provided with a longitudinal slot opening 21 to permit insertion of cards into the frame from the top. The top frame members are desirably spread slightly to facilitate easy insertion of cards therein. Desirably slot 21 also extends a short distance from the top into the frame end walls in order to support an additional card bearing a further advertising message above the top of the frame, as is commonly done to call attention to advertised or unadvertised specials.

Although shown as having a pedestal base, other types of support means may be utilized to hold the frame, such as clamps or the like, depending upon the counter or shelf or rack carrying the merchandise in connection with which the sign is used. The illustrated sign holder is shown as having openings on both sides. In some instances, as where the sign is to be used against a wall so that only one face is visible, only one opening need be provided.

One or more cards 22 and 23 bearing the product name and other information with respect to the product are inserted into the frame through the top slot opening 21 and permitted to rest in the base of the channel forming the bottom of the frame with their edges retained between lips 17 and 18. For conventional use, a card just slightly smaller than the frame must be used so as to occupy all of the space within the frame side openings. However, according to the present invention, narrower cards may be used, as explained further hereinafter, with resulting savings in material, storage space, etc. The messages carried by cards 22 and 23 may be the same, or they may be different. Instead of using two cards, one card printed on one or both sides, as appropriate, may be used.

Interchangeability of price information is achieved through use of a price indicia holder, indicated generally at 24. Holder 24 is generally rectangular and is comprised of a flat rectangular body 25 formed from semi-rigid sheet material such as opaque heat-deformable synthetic resin material, such as pyroxylin, polystyrene, and the like. The holder is of length just slightly less than the inside dimensions of the frame, that is, slightly greater than the length of the frame opening, and of a width substantially less than the width of the frame opening, between about ⅓ and ½ of the opening. A flange 26 is formed along the top edge of the body and contiguous therewith. When the price indicia holder is installed in the frame, flange 26 extends outwardly so as to engage the top edge of the frame to suspend the holder in the slot opening.

The bottom edge of the body is folded outwardly and upwardly to form a relatively narrow pocket extending along the bottom edge of the holder. The pocket includes a flat rectangular front wall 28 which is parallel to and closely spaced from the flat body 25 and contiguous therewith through pocket bottom wall 29. In order to maintain the top of the pocket open, one or more spacer elements 30 are inserted and secured between body wall 25 and pocket front wall 28, adjacent the ends of the pocket. The face of pocket front wall 28 is desirably of a strong contrasting color as compared with the color of the cards 22 and 23 and the exposed face of holder body 25 for store identification, and to call attention to the sign. The bottom edge of the price indicia holder overlaps and overlies the top edge of the product information card and functions as a retainer for the card. The end edges of the indicia holder are retained within the frame end lips.

A plurality of interchangeable price indicia elements 31 are carried in the holder 24. The bottom edge of the indicia element is inserted in the pocket behind face 28 resting upon bottom wall 29. The top edge extends to the inner surface of flange 26 and, when the holder is in place in the frame, is retained by the lip extending along the top of the frame. The numeral, decimal point, or word imprinted on the indicia element is so positioned that it lies within the space between the top of the pocket front wall and bottom edge of the frame top lip when the indicia elements are in place, as illustrated.

Figure 4:
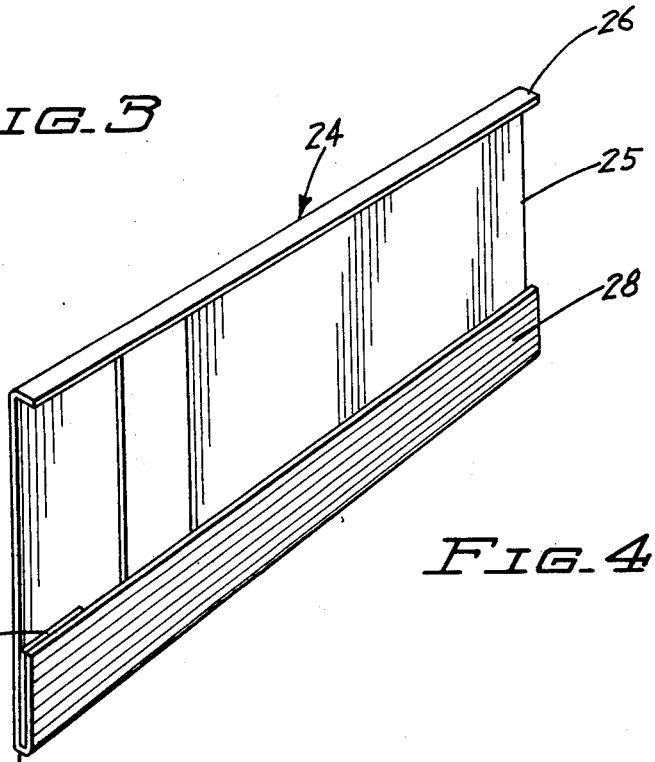
FIG. 4 is a perspective view of a price indicia holder comprising part of the interchangeable sign.

As seen in the drawings, the depth of the relatively narrow pocket formed by front wall 28 is substantially less than half the width of body 25 so as to afford substantial exposure of the price indicia on elements 31. As is clear from FIGS. 3 and 4, the thickness of flat-spacer element 30 which is in face-to-face abutment with front wall 28 and body 25, and the distance by which the front wall is spaced from the body, are substantially equal to the thickness of price indicia elements 31. The indicia elements thus are disposed in face-to-face abutment with the body. The bottom wall 29 of the pocket is continuous and contiguous with both body 25 and front wall 28, being formed by the outward and upward fold of the bottom edge of the body.

When a price change occurs, the indicia holder is simply lifted from the top of the frame, the price indicia elements are interchanged and the holder is reinserted in the frame. Where the frame is double-faced, two indicia holders are inserted in back-to-back relation. Sufficient space remains between the indicia holders to permit the insertion of an additional card bearing a further advertising message supported in the top of the frame and extending upwardly therefrom.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. An interchangeable sign comprising:

A. a relatively flat rectangular frame open on at least one side, having narrow end and bottom walls and having a narrow retaining lip surrounding the opening, B. means for supporting said frame, C. a slot opening in the top of said frame extending the length thereof, D. at least one product information-bearing card in said frame, of length greater than said opening, resting upon the inside bottom frame wall and retained by the portion of the lip adjacent the bottom and end walls, E. at least one price indicia holder in said frame, of length greater than and width substantially lesser than said side opening, 1. said indicia holder having a flat semi-rigid sheet material body and an outwardly extending flange along its top edge, said flange engaging the top edge of the frame to support the holder in said slot opening, 2. a relatively narrow indicia holding pocket extending along the bottom edge of said holder, said pocket including a flat rectangular front wall parallel to and closely spaced from said flat body and contiguous with the bottom edge thereof, 3. the bottom edge of said holder overlying said card and the ends of said indicia holder being retained by the lip adjacent the end walls, and F. a plurality of interchangeable flat rectangular price indicia elements in said holder, the bottom edges of said indicia elements being held in said pocket and the top edges of said elements being retained by the lip adjacent to the top of the frame.

2. A sign according to claim 1 further characterized in that at least one flat spacer element is disposed between the front wall of said indicia holding pocket and the holder body.

3. A sign according to claim 2 further characterized in that said spacer element is adjacent the end of the pocket.

4. A sign according to claim 1 further characterized in that said frame is open on both sides and two price indicia holders are supported in the top slot opening in back-to-back relation.

5. A sign according to claim 1 further characterized in that the front wall of said indicia holder pocket is of a color contrasting from the color of the holder body and the color of the information-bearing card.

6. In combination, a price indicia holder for use in a relatively flat rectangular sign frame which is open on at least one side, has narrow end and bottom walls, has a slot opening in the top of the frame extending the length thereof and has a narrow retaining lip surrounding the opening, and a plurality of price indicia elements held in said indicia holder, said combination including a price indicia holder comprising:

A. an elongated flat rectangular semi-rigid opaque sheet material body of length substantially greater than its width, B. a forwardly extending flange along the top edge of the body and contiguous therewith, and C. a relatively narrow price indicia holding pocket extending along the bottom edge of the holder, said pocket having a depth substantially less than half the width of the body and including a flat rectangular front wall parallel to and closely spaced from said flat body, the bottom wall of said pocket being continuous and contiguous with said flat body and said front wall, and a plurality of price indicia elements:

A. said elements being flat, rectangular members bearing information on at least one face thereof, B. said elements being interchangeable and disposed in side-by-side relation in the pocket of said holder in face-to-face abutment with the body thereof, and C. the bottom edges of said elements being held in said pocket and the top edges of the indicia extending to the flange of said holder, the front wall of the pocket being spaced from said holder body by substantially the thickness of said interchangeable price indicia elements.

7. A combination of a price indicia holder and price indicia elements according to claim 6 further characterized in that at least one flat spacer element is disposed between and in face-to-face abutment with the front wall of said indicia holding pocket and the holder body, the thickness of said spacer element being substantially the thickness of said price indicia elements.

8. A combination of a price indicia holder and price indicia elements according to claim 7 further characterized in that said spacer element is adjacent the end of the pocket.

9. A combination of a price indicia holder and price indicia elements according to claim 6 further characterized in that the front wall of said pocket is of a color contrasting from the color of the body.

10. A sign according to claim 1 further characterized in that:

A. said price indicia holder is formed from opaque sheet material,

B. the indicia holding pocket has a depth substantially less than half the width of the holder body, C. the bottom wall of the pocket is continuous and contiguous with the bottom edges of the holder body and pocket front wall, said price indicia elements are disposed in said pocket in face to face abutment with said holder body, and E. said pocket front wall is spaced from the body by substantially the thickness of said price indicia elements.

* * * * *

UNITED STATES PATENT AND TRADEMARK OFFICE

CERTIFICATE OF CORRECTION

PATENT NO. : 3,982,342

DATED : September 28, 1976

INVENTOR(S) : Charles T. Moore

It is certified that error appears in the above-identified patent and that said Letters Patent are hereby corrected as shown below:

Column 6, line 20, before "said", --D.-- should be inserted

Signed and Sealed this

Eleventh Day of January 1977

[SEAL]

*Attest:*

RUTH C. MASON
*Attesting Officer*

C. MARSHALL DANN
*Commissioner of Patents and Trademarks*